US005690014A

United States Patent [19]

Larkin

[11] Patent Number: 5,690,014

[45] Date of Patent: Nov. 25, 1997

[54] SMALL DIAMETER IONIZING CORD FOR REMOVING STATIC CHARGE

[76] Inventor: William J. Larkin, 27 Parsons Dr., Swampscott, Mass. 01907

[21] Appl. No.: 464,973

[22] Filed: Jun. 5, 1995

Related U.S. Application Data

[63] Continuation-in-part of Ser. No. 247,051, May 20, 1994, Pat. No. 5,501,899.

[51] Int. Cl.[6] ..... D04C 1/00

[52] U.S. Cl. ..... 87/13; 57/901; 87/3; 87/6; 87/9

[58] Field of Search ..... 57/901, 3, 6, 8, 57/9, 11, 12, 13

[56] References Cited

U.S. PATENT DOCUMENTS

| | | | |
|---|---|---|---|
| 3,475,213 | 10/1969 | Stow | 428/344 |
| 3,678,675 | 7/1972 | Klein | 57/901 |
| 3,699,768 | 10/1972 | Roberts et al. | 57/901 |
| 3,757,164 | 9/1973 | Binkowski | 317/2 R |
| 3,882,667 | 5/1975 | Barry | 57/901 |
| 3,904,929 | 9/1975 | Kanaya et al. | 317/2 R |
| 3,936,170 | 2/1976 | Shibano et al. | 355/3 |
| 3,985,530 | 10/1976 | Maekawa | 428/922 |
| 4,364,739 | 12/1982 | Tomibe et al. | 8/654 |
| 4,410,593 | 10/1983 | Tomibe et al. | 428/389 |
| 4,553,191 | 11/1985 | Franks et al. | 361/212 |
| 4,563,232 | 1/1986 | Peake | 428/261 |
| 4,684,762 | 8/1987 | Gladfelter | 174/36 |
| 4,961,804 | 10/1990 | Aurichio | 428/40 |
| 4,966,729 | 10/1990 | Carmona et al. | 252/511 |
| 4,971,726 | 11/1990 | Maneno et al. | 252/511 |
| 4,976,890 | 12/1990 | Felter et al. | 252/511 |
| 4,983,148 | 1/1991 | Nakagawa | 474/263 |
| 5,049,850 | 9/1991 | Evans | 338/22 R |
| 5,075,036 | 12/1991 | Parish et al. | 252/511 |
| 5,082,595 | 1/1992 | Glackin | 252/511 |
| 5,084,211 | 1/1992 | Kawaguchi et al. | 252/511 |
| 5,240,769 | 8/1993 | Ueda et al. | 428/365 |
| 5,246,771 | 9/1993 | Kawaguchi | 428/344 |
| 5,262,229 | 11/1993 | Lampert et al. | 428/344 |
| 5,354,607 | 10/1994 | Swift et al. | 428/294 |
| 5,501,899 | 3/1996 | Larkin | 428/288 |

OTHER PUBLICATIONS

Luxon "EMI/FI Shielding", Soc Plastic Engrs., Chicago Section, Tech. Conf. Abstract 1984.

Fahey et al, "Architectural Shielding with Advanced Non-woven Structures".

Brochure, Nippon Sammo Dyeing Co, Ltd.

Various Brochures, American Cyanamid Co., Re Cycom MCG Fiber Prods. Jul. 1985.

Various Product Literature, International Paper, Re Safn-shielded Prod. Feb. 1989.

*Primary Examiner*—William Stryjewski

*Attorney, Agent, or Firm*—Frances P. Craig

[57] ABSTRACT

A small diameter ionizing cord for use in an apparatus through which insulative material flows or is propelled. The ionizing cord has an outer surface and includes three or more strands of electrically non-conductive fibers braided to form a smooth cord having an effective diameter of about 0.5–6 mm. At least one of the strands is a static control strand including a multiplicity of electrically conductive microfibers being in electrically conductive communication with one another along the length of the strand. The microfibers are selected to provide a multiplicity of ionizing points disposed along the length of the cord and exposed at or extending minimally above the outer surface such that, when the strand is electrically grounded or electrically charged, air between the ionizing points and the material passing the outer surface is sufficiently ionized to remove static charge from the material or to attract or repel the material to or from the apparatus surface. The microfibers of the ionizing cord typically are about 0.5–50 μm in diameter and about 2–8 cm long, and carbon, metal coated carbon, copper, stainless steel, metal coated acrylic, metallized acrylic, or electrically conductive polymers. Methods for fabricating and using the small diameter ionizing cord are also disclosed.

6 Claims, 3 Drawing Sheets

SMALL DIAMETER IONIZING CORD FOR REMOVING STATIC CHARGE

CROSS REFERENCE TO RELATED APPLICATIONS

The present application is a continuation-in-part of U.S. patent application Ser. No. 08/247,051, filed May 20, 1994, now U.S. Pat. No. 5,501,899, incorporated herein by reference.

BACKGROUND OF THE INVENTION

The present invention relates to the discharging of static electricity, and particularly to a device and method for removing static charge from a surface by ionization of air.

Static electricity is defined as surface storage of electric charge. This surface charge is caused by the transfer of electrons when two similar or dissimilar surfaces contact. The charge also creates a voltage field which attracts or repels other objects which are proximate to the field. (This attraction or repulsion can create problems, as will be discussed further hereinafter.) This voltage pressure or potential induces out from the surface in all directions when the charged object is in space. It is the induced voltage pressure which allows the static charge to ionize.

The typical method for controlling static on conductors, e.g., metal objects or people, is to ground them. For example, a charge buildup may be prevented on a human operator by providing a path to ground for the charge by such means as grounded conductive mats, conductive wrist straps, and conductive shoe straps. However, only objects that will conduct electrical energy or charge can be grounded. In conventional static control cords to be worn, e.g., on the ankle or wrist of a human operator or attached, e.g., to a conductive portion of a machine, long, conductive wires are twisted, woven, or braided together to prevent buildup of static charge.

The major problem in static control on insulators, e.g., plastics, synthetics, or paper, is that by definition insulators cannot be grounded. Further, when an insulative material contacts a grounded conductive surface, the insulator cannot give up its surface charge. (The term "insulative", as used herein, is defined by Section 2.2.2.4 of the Electronic Industry (EIA) Standards, EIA-541, page 3.) Also, there will be a transfer of electrons taking place due to such contact, which can further charge the surface of the insulative material. The insulative surface, having a greater affinity for electrons, will often build up a negative charge, while the opposite polarity generated on the conductive surface will instantaneously be conducted to ground. Thus, even if machine surfaces are made from a metal or other conductor (s) and are grounded, they cannot eliminate static charge buildup on non-conductive objects or materials coming in contact with them. Further, a static charge can be generated on surfaces of such non-conductors by their contact with grounded conductors.

Even more problematical is the fact that an insulative material in motion can contact another surface causing triboelectric generation of static charge and the resulting cling without ever separating from the surface. Static generation is most commonly observed when similar and dissimilar materials contact and separate. However, the static generation occurs as soon as one material touches the other. As the molecules of one material contact those of another material, there is a transfer of electrons and the resultant static charge generation, i.e., cling, drag, misalignment, electrostatic discharge (ESD). Also, the materials are in intimate contact and are affected by high capacitance. When there is high capacitance, there is insufficient voltage pressure to ionize the air by conventional means, including induction or active ionization. The term "ionization of air", as used herein, is defined as the breakdown of air into positive and negative ions.

In another example, a fine filament, e.g., a thread, fiber, or yarn, is passed through a conduit, e.g., a tube or pipe, which supports it through space. An example of such apparatus is an air blown piping system. Similar apparatus may be used to transport powders or particulate materials. There is contact between the filament, powder, etc. and the walls of the conduit, generating a static charge. The resulting cling or drag can cause severe handling problems. Even the use of conductive plastic or metal conduit does not solve the problem; in some cases the problem is even more severe due to triboelectric generation of static charge on the insulative filament as the dissimilar materials of the filament and conduit contact and separate. Conventional static eliminators are not effective in this application not only because of the capacitance of the charged filament within the conduit but also because of space restrictions within the conduit itself.

Yet another example involves the transport of a light, flat, insulative material, e.g., paper, plastic, fabric, etc., across another flat surface without continuous support, e.g., a flat envelope contacting the side surfaces of a machine, a sheet of paper sliding down a feed board of a printing or copy machine, a fabric sliding across a flat surface of a cutting machine, or a thin sheet of plastic film moving across the flat surfaces of a film processing machine. In each case the material, by contact with the machine surface, can develop a static charge which results in handling or ESD problems. While the material is in contact with the machine surface, it has a higher capacitance and a reduced voltage pressure; thus the static charge cannot be effectively removed by conventional static eliminators.

Ways of controlling static charge are known. Induction static eliminators take advantage of the electric field (or voltage field) around a statically charged surface by inducing ionization of the air at or near conductive points (or ends) of small cross-sectional area within the electric field. The voltage pressure or potential is increased around the conductive points, inducing ionization of the air; the ionized air and the conductive points provide a path to ground for the charge. Known induction static eliminators typically use a fixed row of grounded bundles or brushes of conductive threads or fine wires, or grounded strips, e.g. of copper, held perpendicularly to a passing surface to touch or nearly touch the charged surface to ionize the air within the voltage field. The small cross-sectional area at the tip of each thread or fine wire or end point of each strip increases the voltage pressure or potential at the tip, end, or point (hereinafter "point"), inducing ionization of the air surrounding the point. Alternatively, the grounded bundles or brushes may be electrically powered to neutralize nearby charges.

Also alternatively, the grounded conductive material may be in the form of "tinsel", a strand of thin, conductive metal strips, e.g., of copper, twisted together with, e.g., wire so that the strips radiate outwardly from the wire axis. A typical diameter for such tinsel is about 1¼–1½ inches (about 30–40 mm). The small cross-sectional surface area of the strip ends and the proximity of these ends to the charged surface provides the above-described ionizing points, enabling ionization of the air within the voltage field and conduction of the charge to ground. Tinsel is used in, e.g., the printing, paper, film, and material converting industries as an important means to control static on such materials as they are handled or processed through machines.

However, the bulky nature of tinsel, i.e., its large diameter limits its use in narrow openings of a machine or under passing materials to control static. Also, tinsel is formed from twisted strips of copper or other metal, which can scratch or mar delicate materials, e.g., coated materials, photographic film, etc. Too, it has been found that static is not uniformly removed across the material by using tinsel. Many of the materials used to form such tinsel are readily oxidized, affecting conductivity and, consequently, static control performance. Further, the thin metal strips of the tinsel tend to become pressed together and matted with storage, handling, and use, decreasing their availability for ionization and affecting performance. Still further, because of the metallic nature of its strips and its twisted construction, tinsel is subject to breakage of portions of the strips from the wrapping wire. Such breakage not only seriously affects performance of the tinsel, it can also lead to release of pieces of the metal strips onto the passing material and into the machine parts. Finally, the materials from which tinsel is typically made do not meet clean room standards, which often require that machines be constructed of high grade stainless steel. Short-lived tinsel would be uneconomical to fabricate from such expensive material.

It would be desirable to have a small diameter, rugged means of eliminating the static charge on passing materials using inductive or active ionization. For example, it would be desirable to have a static eliminating means which can be installed in closed or restricted areas of the machine and/or can be incorporated into a surface directly under the moving sheets as they pass through the machine. Prior art static eliminators such as tinsel are too bulky and/or fragile to be useful in such ways. The small diameter ionizing cord described herein was developed to address the need for a sturdy, small diameter, low cost static eliminator capable of neutralizing static charge on an insulative material passing near its surface.

SUMMARY OF THE INVENTION

In one embodiment, the invention is a small diameter ionizing cord for removing static charge from insulative material flowing or being propelled through an apparatus. The ionizing cord has an outer surface and includes three or more strands of electrically non-conductive fibers braided to form a smooth cord having an effective diameter of about 0.5–6 mm. At least one of the strands is a static control strand including a multiplicity of electrically conductive microfibers being in electrically conductive communication with one another along the length of the strand. The microfibers are selected to provide a multiplicity of ionizing points disposed along the length of the cord and exposed at or extending minimally above the outer surface such that, when the strand is electrically grounded or electrically charged, air between the ionizing points and a statically charged material passing the outer surface is sufficiently ionized to remove static charge from the material. In narrower embodiments, the microfibers of the ionizing cord are about 0.5–50 μm in diameter and about 2–8 cm long, and are selected from carbon, metal coated carbon, copper, stainless steel, metal coated acrylic, metallized acrylic, and electrically conductive polymers.

In another embodiment, the invention is a method of fabricating the above-described ionizing cord. The method involves forming a first strand of electrically non-conductive fibers, the length of the first strand being at least the same as the length of the cord. The first strand includes a multiplicity of microfibers bundled together with the electrically non-conductive fibers. The first strand is braided with two or more additional fibrous strands to form the cord, each of the additional fibrous strands being a strand of electrically non-conductive fibers, with or without microfibers included therein. The first strand of said cord is a static control strand in which the microfibers are electrically conductive microfibers in electrically conductive communication with one another along the length of the static control strand. The microfibers provide a multiplicity of ionizing points disposed along the length of the cord and exposed at or extending minimally above the cord outer surface such that, when the static control strand is electrically grounded or electrically charged, air between the ionizing points and the material passing the cord outer surface is sufficiently ionized to remove static charge from the material, and wherein each of said additional fibrous strands is a strand of electrically non-conductive fibers, with or without electrically conductive microfibers included therein.

In yet another embodiment, the invention is a method for ionizing air between a surface of an apparatus and insulative material passing the apparatus surface. The method involves stringing across the apparatus surface the above-described small diameter ionizing cord. The cord includes three or more strands of electrically non-conductive fibers braided to form a smooth cord having a diameter of about 0.5–6 mm, at least one of the strands being a static control strand as described above. As described above, a multiplicity of ionizing points are disposed along the length of the cord and are exposed at or extend minimally above the outer surface of the cord such that, when the strand is electrically grounded or electrically charged, air between the ionizing points and the material passing the outer surface is sufficiently ionized to remove static charge from the material. The ionizing cord is electrically grounded or an electric charge is applied thereto. The material is passed through the apparatus across or near the cord outer surface.

BRIEF DESCRIPTION OF THE DRAWINGS

For a better understanding of the present invention, together with other objects, advantages, and capabilities thereof, reference is made to the following Description and appended claims, together with the Drawings in which:

DETAILED DESCRIPTION OF THE PREFERRED EMBODIMENTS

Figure 1:
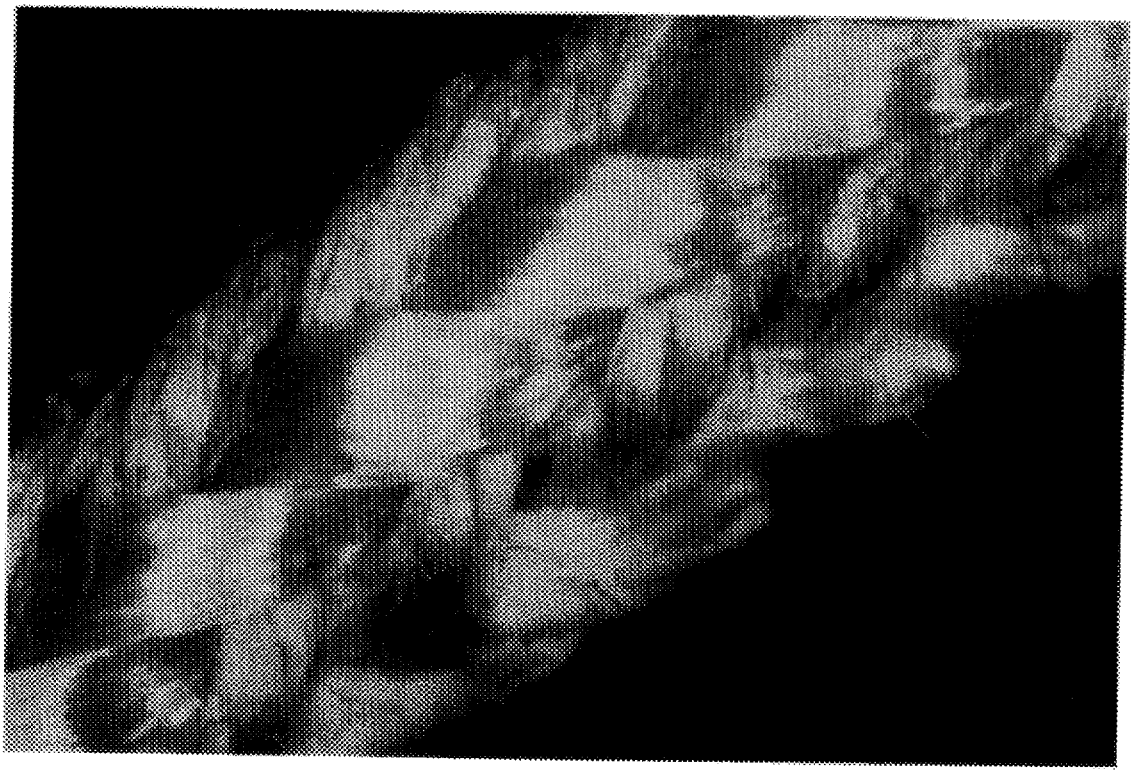
FIG. 1 is a photomicrograph of a small diameter ionizing cord in accordance with one embodiment of the invention.

The small diameter ionizing cord described herein includes strands of fibers braided together to form the cord.

Each strand is made up of electrically non-conductive fibers bunched together in a twisted or non-twisted relationship. One or more static control strands is braided into the cord, i.e., the cord may be made up partly or completely of static control strands. Static control strands and non-static control strands both include the above-described electrically non-conductive fibers. However, the static control strands include many electrically conductive microfibers bunched together with the non-conductive fibers in such a way that the conductive microfibers are in electrically conductive communication with one another, i.e., that an electric charge may travel from one to another of the conductive microfibers. Parts of the conductive microfibers are exposed at the surface of the cord along its length, and thus some of these microfiber parts are exposed at the ionizing cord surface along its length, extending only minimally, i.e., less than about 1 mm, thereabove. The exposed microfiber parts may be microfiber ends, or may be folded or sharply bent sections, providing ionizing points randomly disposed along the length of the ionizing cord to remove static charge from insulative material passing the cord.

By the term "cord", as used herein, is meant a rope-like, woven or braided, small diameter string having a length much greater, e.g., at least an order of magnitude greater, than its diameter. Typically, the cord described herein is generally cylindrical in cross-section, but the term "cord" is also intended to include tape-like string of similar small effective diameter, e.g., that having a rectangular or oval cross-section, or other type of string. The diameter or effective diameter of the ionizing cord described herein is about 0.5–6 mm, preferably about 1–4 mm. The "effective diameter" is a term describing a diameter defining an equivalent cross-sectional area to that of the cord.

The term "braided", as used herein is intended to mean braided, twisted, knitted, or woven together with each of the strands crossing over then under, or wrapping around, one or more other strands along the length of the cord. The cord includes at least two strands, but may include any number greater than three with which it is possible to fabricate a cord up to about 6 mm. Conveniently, the ionizing cord may be of a length at least several times the average length required for a single installation. The required length may then be, e.g., unrolled from a reel, cut, and installed.

The term "strand", as used herein, is intended to mean a number of fibers bunched together, either twisted together or not twisted together, to extend generally parallel to one another along the length of the strand. Each fiber may extend along the full length of the strand or along only a part of the length of the strand (as in a spun thread). Preferably, each strand of non-conductive fibers is generally smooth-surfaced. The conductive microfibers, if present, extend generally axially but are exposed at the smooth surface of the strand, extending only minimally thereabove. Alternatively, the fibers may be arranged in another relationship to one another in the strand, e.g., braided, knitted, or woven together. The gathering into strands of the appropriate non-conductive fibers, with or without the conductive microfibers, and the weaving, twisting, knitting, or braiding of the strands to form the ionizing cord are performed in accordance with known industrial processes for making woven, knitted, twisted, or braided cord of the prior art, to achieve the desired low-profile network may be accomplished in any of several ways.

By the term "short microfibers", as used herein, is intended fibers about 0.5–50 μm, preferably about 8–12 μm, in diameter and about 2–8 cm, preferably about 5 cm, long. As can be seen from these size ranges, although the fibers may be short the aspect ratio (length to diameter) of the fibers is high. The small cross-sectional area at each exposed microfiber end, fold, or sharp bend provides the required "ionizing points" to induce ionization. That is, the voltage pressure or potential at each microfiber ionizing point is increased, inducing ionization of the air between the passing statically charged material and the microfiber ionizing points. The conductive ionizing points and the conductive microfibers throughout the cord provide a path to ground for the charge. Suitable electrically conductive materials for the microfibers include, but are not limited to stainless steel, carbon, metal coated carbon, copper, metallized or metal coated acrylics, and conductive polymers. The entire fiber may be fabricated from the conductive material or, alternatively, a conductive or non-conductive fiber core may be coated with a conductive material or metallized to form the electrically conductive microfibers.

Preferred for the microfibers is stainless steel microfiber. Less preferred is carbon microfiber or carbon microfiber coated with a very thin layer of a metal such as nickel. The microfibers may be fabricated by spinning, extrusion, drawing, or other known process for producing microfibers of the above-described diameter. The length produced by such processes, however, is normally far greater than that suitable for the relatively short microfibers described herein. The fibers may be cut (chopped) or otherwise shortened for use in the above-described network. The non-conductive fibers may be fabricated from any suitable natural or synthetic yarn, e.g., cotton, rayon, nylon, or polyester.

In an alternative embodiment, microfibers which are not conductive, e.g., of polymeric materials, may be incorporated into the strands with the above-described non-conductive fibers, and the microfibers rendered conductive by treating the strand or the braided cord. For example, the strand or cord may be metallized, or may be dipped or otherwise treated, e.g., with conductive dye or ink to render the microfibers conductive. After treatment the resulting cord, however, still includes both conductive microfibers and non-conductive fibers as described above. Some of the microfiber ends, folds, or bends are exposed at the surface of the treated cord along its length, as described above. Thus, ionizing points are randomly disposed along the length of the ionizing cord to remove static charge from insulative material passing the cord, as described above.

The description below of various illustrative embodiments shown in the Drawings is not intended to limit the scope of the present invention, but merely to be illustrative and representative thereof.

An exemplary embodiment of the small diameter ionizing cord in accordance with the invention is shown in FIG. 1. FIG. 1 is a photomicrograph, at 40× magnification, showing an ionizing cord about 2–3 mm in diameter. The cord includes eight strands of fibers braided into a generally cylindrical shape. Four of the strands are static control strands interwoven with four non-static control strands. Both static control strands and non-static control strands are made up of electrically non-conductive fibers bunched together in a slightly twisted relationship. However, the static control strands include many electrically conductive microfibers bunched together with the non-conductive fibers in such a way that the conductive microfibers are in electrically conductive communication with one another. As may be seen in FIG. 1, parts of the conductive microfibers are exposed at the surface of the ionizing cord along its length, extending minimally therefrom. There are microfiber ends and folded or sharply bent sections exposed at this cord surface, providing ionizing points along the length of the ionizing cord.

The static control strands wrap in left-hand helices about an imaginary cord axis while the non-static control strands wrap in right-hand helices about the axis. Each non-static control strand passes over two and under two of the static control strands, while each static control strand passes over two and under two of the non-static control strands. This braiding pattern provides four rows of approximately diamond-shaped portions of the static control strands being visible at the surface of the ionizing cord, the four rows alternating with four similar rows of visible portions of non-static control strands. Thus, microfibers are exposed on four sides of the surface of the ionizing cord. The static control strands of FIG. 1 include stainless steel microfibers randomly mixed with the non-conducting fibers, which are of Nylon. The strands shown in FIG. 1 are made up of all white non-conductive fibers, but the fibers may be colored if desired. Distinctive patterns may be provided by using colored fibers for some of the strands and by varying the number of strands of each type and the braiding pattern.

In operation, typically, the ionizing cord is installed within an apparatus or machine through which paper, other insulating sheets, or other statically chargeable materials flow or are propelled. Examples of such a machine are a printing press, office copier, printer, or other materials processing equipment. In such a machine, each sheet (or other material) is nearly continuously resting on or moving across, e.g., stacked sheets, feed boards, tapes, rollers, or other surfaces, and is likely to build up a static charge on its surfaces. The ionizing cord is cut to the desired length, if necessary, and fastened at each end to the machine to be suspended across the space or gap defining the feed path, above or below the passing material from which static is to be removed.

In typical embodiments of the ionizing cord, ionizing points are found at least on opposite sides of the ionizing cord and the statically charged material can pass on either side of the cord. Alternatively, volumes of air can be ionized or charged as the air passes by the cord. The ionizing cord is grounded at at least one end or, alternatively, a positive, negative, or alternating charge may be applied to the cord. Also alternatively, an adhesive may be used to bond the ionizing cord to a machine surface, and the cord may be grounded or charge applied. Conventional techniques may be used for grounding the ionizing cord. For example, the cord ends may be crimped into a conventional U-shaped electrical connector which, in turn, may be attached to the machine by screws. Alternatively, the ionizing cord may be bonded by a conductive adhesive to a metal or other conductive machine surface, and the machine surface may be grounded in a conventional manner. As each sheet passes across the grounded ionizing cord, static charge buildup on the sheet is neutralized by ionization. The ionizing cord described herein acts to neutralize the surface charge on materials on or near its surface, either by induction, ionizing the air in the electric field (or voltage field) to provide a path to ground for the excess charge, or by providing sufficient positive or negative charge to balance the surface charge.

As mentioned above, the diameter of the preferred ionizing cord is quite small and, generally, the ionizing points of the conductive microfibers extend minimally above the exposed surface of the cord. Thus, the ionizing cord may be installed so that few if any of the fiber ionizing points contact the surface from which static charge is to be removed.

The following theoretical explanation of the mechanism by which the ionizing cord operates inductively is presented as an aid to understanding of the invention, and is not intended as a limitation on the invention described herein. The surface charge on a moving material, e.g. a sheet material, creates an electric field around the material. Enough of the microfiber ends, folds, and sharp bends present throughout the cord are sufficiently close to the surface of the cord and are sufficiently small in diameter to act as the above-described inductive ionizing points. That is, the statically charged material's electric field becomes concentrated at these microfiber ionizing points at the cord surface as the charged material passes, ionizing the air between the charged material and the cord. The surface charge then flows across the ionized air and through the conductive microfibers to ground.

Alternatively to grounding the ionizing cord for inductive static control, a voltage may be applied to the cord from an external voltage source by conventional means, the voltage being sufficient to ionize the air immediately adjacent the surface of the cord to neutralize the excess surface charge on the material passing near the ionizing cord. Typically, an ac or dc voltage source is used to produce both positive and negative ions, the voltage being capacitively coupled to the ionizing cord through an insulator, in a conventional manner, to avoid discharge of voltage from the cord. The passing charged material then attracts either positive or negative ions to neutralize its surface charge. Also alternatively, a pulsed ac or dc voltage source or a piezoelectric or other voltage source may be used to provide voltage to the microfibers and thus provide the ionization required to neutralize the surface charge.

In alternate applications, the ionizing cord can be used to charge materials coming near its surface by using a single voltage polarity to induce a polarity onto the passing material to cause it to become charged and to cling to or repel machine surfaces.

Figure 2:
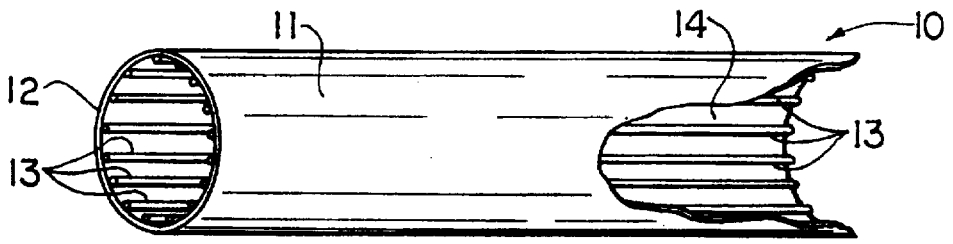
FIG. 2 is a schematic elevation view, partly in cross-section, of a conduit having small diameter ionizing cords in accordance with yet another embodiment of the invention installed therein.

In a particularly useful embodiment of the invention, shown in FIG. 2, ionizing cord device 10 is applied to the interior of conduit 11 which may be, e.g., a tube or pipe, designed to support and guide a filament (not shown) such as a thread, fiber, or yarn or, alternatively, a powder or particles through space in an air blown piping system, as described above. There is some contact between the filament or other material and wall 12 of the conduit, but any static charge generated is controlled by ionizing cord device 10, preventing severe handling problems due to cling, drag, etc.

Device 10 is fabricated by adhering small diameter ionizing cords 13 to interior surface 14 of conduit wall 12 parallel to the axis of conduit 11. The ionizing cords may then be grounded or voltage applied in known manner to eliminate static problems. Alternatively, ionizing cords 13 may be applied to surface 14 in a helical pattern, or to only certain portions of the conduit, e.g., within the elbow fittings (not shown) of conduit 11. If necessary, the conduit may be adapted to overcome severe interior space restrictions, e.g., by forming interior grooves (not shown) within the conduit to receive the small diameter ionizing cords.

Figure 3:
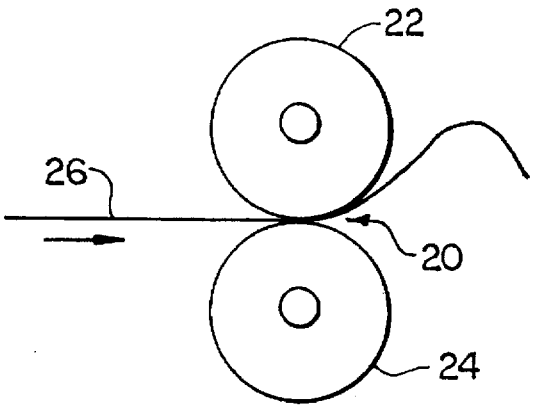
FIG. 3 is a schematic elevation view of a roller section of a sheet material processing apparatus, illustrating a material handling problem.
Figure 4:
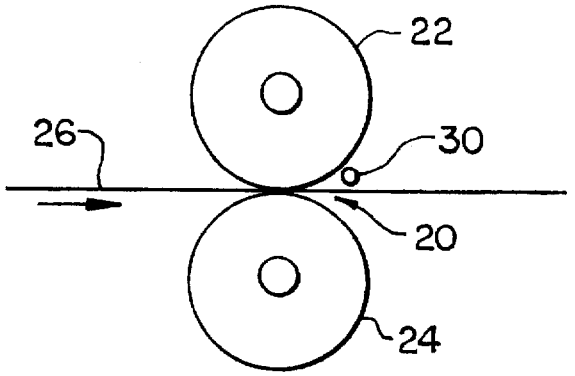
FIG. 4 is a schematic elevation view of the sheet material and roller section of FIG. 3, illustrating the solution, using the small diameter ionizing cord in accordance with still another embodiment of the invention, of the material handling problem illustrated in FIG. 3.

Another useful embodiment of the invention may be used to address the problem, As shown in FIG. 3, as it exits the nip 20 between insulative drive rollers 22 and 24, statically charged sheet material 26 tends to follow drive roller 22, e.g., of rubber, and get out of track, as at 28. FIG. 4 illustrates ionizing cord device 30 stretched across nip 20 between drive rollers 22 and 24, parallel to nip 20. Device 30 removes static charge from material 26, preventing severe handling problems due to clinging of the material to the rollers. Device 30 may be fabricated by grounding the above-described small diameter ionizing cord or by applying voltage to the small diameter ionizing cord in known manner.

In addition to its efficient removal of static charge from the material passing through the nip, the ionizing cord presents the advantage of a small diameter device, e.g., about 0.5–6 mm in diameter, placed close to the nip. In comparison, a typical electrical static eliminator has a diameter of about ½", while a strand of tinsel has a diameter of about 1¼". These larger diameter devices could not be placed as close to the nip as can the device fabricated from the small diameter ionizing cord described herein.

The following Examples are presented to enable those skilled in the art to more clearly understand and practice the present invention. These Examples should not be considered as limitations upon the scope of the present invention, but merely as being illustrative and representative thereof.

EXAMPLES

The efficiency of ionization of air by the ionizing cord in accordance with one embodiment of the invention was tested by bringing a statically charged insulative tape material near to the ionizing cord under test, the ionization of air acting to remove static charge from the insulative tape. The ionizing cord used in the tests was similar to that shown in FIG. 1, i.e., many ionizing points were exposed at or extending minimally above the surface of the ionizing cord, and was an 8 strand braided cord about 3 mm in diameter. As a control, a conductive multistrand copper wire of about 1/16" diameter was subjected to the same tests.

Example 1

A single length of about 3" of the ionizing cord was affixed to a flat, grounded conductive work surface by taping down the cut ends to eliminate any ionizing effect of the cut edges, to increase the capacitance, and to ground the cord. The conductive work surface was a carbon loaded polyethylene (10E6 ohms/square, per ASTM Standard D257). A similar test sample of about the same length was prepared from the multistrand copper wire.

The relative humidity of the work area was maintained below 45% to minimize charge leakage. The human operator was grounded with a 1 megohm wrist strap while performing the tests.

A ¾" wide strip of Minnesota Mining & Manufacturing Co. Scotch Brand Transparent Tape, No. 810, an insulative material, was rapidly unwound from its roll to a length of approximately 14 inches to generate a static charge of greater than 10 KV voltage on the surface of the tape strip. The voltage of the static charge on the tape was measured using two electrostatic sensors, Trek Inc. (Medina, N.Y.) Model 510A, placed on a flat work surface. The charged tape was passed over the ionizing cord or multistrand wire under test, leaving a gap of 1", ½", or ⅛" between the charged tape and the cord or wire. The charged tape was not permitted to contact the ionizing cord or wire. After each pass the residual voltage on the charged tape was measured with the Trek electrostatic sensors. A fresh length of tape was unwound for each pass.

Figure 5:
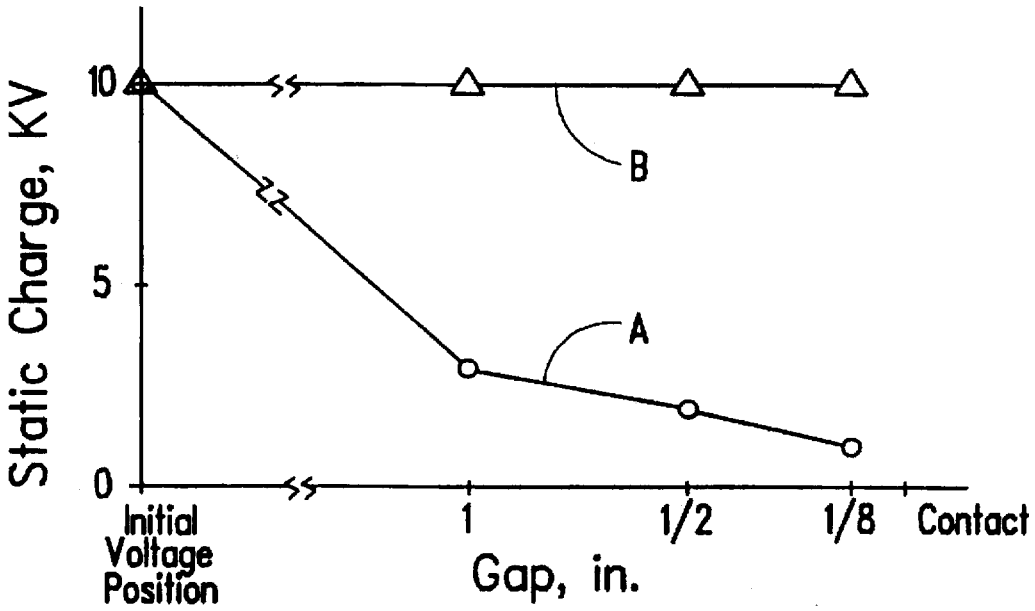
FIGS. 5 and 6 are a graphic representations of the efficacy of the small diameter ionizing cord in accordance with another embodiment of the invention.

The residual voltage for each pass, shown in FIG. 5, shows that the ionizing cord (Line A) provided sufficient ionization of air to effectively remove static charge from the insulating tape without electrical contact of the tape to the ionizing cord. The efficient ionization of air between an insulating surface and the ionizing cord, reducing the static charge on the insulating surface, was achieved because sufficient grounded, conductive, ionizing points were present near or at the surface of the cord to induce ionization of air. The ionization provided the required path to ground to reduce the static charge. As may be seen in FIG. 5, the multistrand copper wire (Line B) was totally ineffective in removing static charge.

Example 2

The insulative tape was charged at least 10 KV and suspended in space to minimize the effects of capacitance. A length of about 7" of the same ionizing cord, or of the same multistrand copper wire, as used in Example 1 was grounded, held at each end by a grounded operator, and passed by the surface of the charged tape, without allowing the cord or wire to contact the tape, leaving a gap of 1", ½", or ⅛ between the charged tape and the cord or wire. Other test conditions were as described for Example 1. After each pass the residual voltage on the charged tape was measured with the Trek electrostatic sensors. A fresh length of tape was unwound for each pass.

Figure 6:
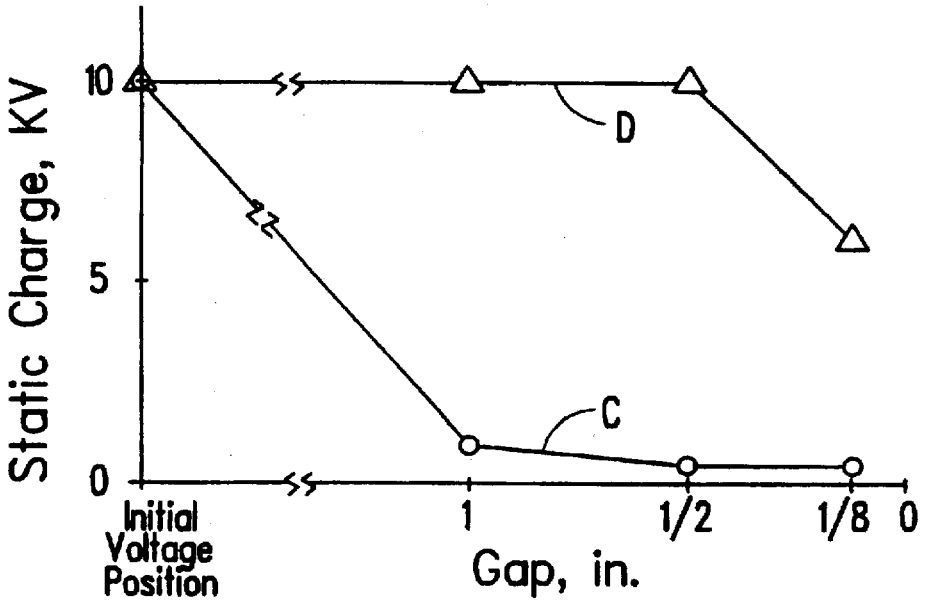

The residual voltage for each pass, shown in FIG. 6, shows that the ionizing cord (Line C) provided sufficient ionization of air to effectively remove static charge from the insulating tape without electrical contact of the tape to the ionizing cord. As in Example 1, the efficient ionization of air between an insulating surface and the ionizing cord, reducing the static charge on the insulating surface, was achieved because sufficient grounded, conductive, ionizing points were present near or at the surface of the cord to induce ionization of air. The ionization provided the required path to ground to reduce the static charge. As shown in FIG. 6, the multistrand copper wire (Line D) was totally ineffective in removing static charge at the 1" and ½" gaps. The static charge at ⅛" was reduced to about 6 KV, the voltage on the insulative tape being sufficiently high and the gap sufficiently small to result in arcing of the charge across the gap. Even after this reduction, however, the static charge on the insulative tape was still an order of magnitude higher (6 KV) than that remaining on the tape after the ⅛" pass by the ionizing cord (0.5 KV).

The invention described herein presents to the art a novel, non-bulky, small diameter ionizing cord which can effectively eliminate static charge, by induction or active ionization, from the surface of a charged material. The ionizing cord is useful in such machines as printing or die cutting apparatus, or presses, copiers, or other machines through which materials are propelled. The ionizing cord is particularly valuable when static must be controlled under capacitive conditions, that is when other objects or surfaces are in close proximity to the charged material. The novel ionizing cord can be installed to be suspended over or under the feed path of a material or to be integral with the surfaces over which the material must pass, overcoming the problem of capacitance. For example, the ionizing cord can be installed in closed or restricted areas of an apparatus where the bulkiness of prior art static eliminators prevent their use and/or it may be installed to cover a surface directly under moving sheets as they pass through a copier, press, or other machine.

While there has been shown and described what are at present considered the preferred embodiments of the invention, it will be apparent to those skilled in the art that modifications and changes can be made therein without departing from the scope of the present invention as defined by the appended claims.

I claim:

1. A small diameter ionizing cord for removing static charge from insulative material flowing or being propelled through an apparatus, said ionizing cord having an outer surface and comprising three or more strands of electrically non-conductive fibers braided to form a cord having an effective diameter of about 0.5 mm to about 6 mm, at least one of said strands being a static control strand including a multiplicity of electrically conductive microfibers being in electrically conductive communication with one another along the length of said strand, said microfibers providing a multiplicity of ionizing points disposed along the length of said cord and exposed at said outer surface such that, when said strand is electrically grounded or electrically charged, air between said ionizing points and said material passing said outer surface is sufficiently ionized to remove static charge from said material.

2. An ionizing cord in accordance with claim 1 wherein said ionizing cord is generally cylindrical in shape.

3. An ionizing cord in accordance with claim 1 wherein said microfibers are about 0.5 μm to about 50 μm in diameter and about 2 cm to about 8 cm long.

4. An ionizing cord in accordance with claim 1 wherein said electrically conductive microfibers are selected from the group consisting of carbon, metal coated carbon, copper, stainless steel, metal coated acrylic, metallized acrylic, and electrically conductive polymers.

5. An ionizing cord in accordance with claim 1 wherein said cord diameter is about 1 mm to about 4 mm.

6. An ionizing cord in accordance with claim 1 wherein said microfibers have a conductive or non-conductive core metallized, coated, or treated with a conductive material.

* * * * *